US008590581B2

(12) United States Patent
Clüsserath

(10) Patent No.: US 8,590,581 B2
(45) Date of Patent: Nov. 26, 2013

(54) METHOD AND FILLING SYSTEM FOR FILLING BOTTLES OR SIMILAR CONTAINERS WITH A LIQUID FILLING MATERIAL AND FILLING MATERIAL DISPENSED INTO CONTAINERS

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 274 days.

(21) Appl. No.: 12/989,171

(22) PCT Filed: Apr. 9, 2009

(86) PCT No.: PCT/EP2009/002666

§ 371 (c)(1),
(2), (4) Date: Oct. 22, 2010

(87) PCT Pub. No.: WO2009/129937

PCT Pub. Date: Oct. 29, 2009

(65) Prior Publication Data

US 2011/0039044 A1 Feb. 17, 2011

(30) Foreign Application Priority Data

Apr. 22, 2008 (DE) ..... 10 2008 020 271

(51) Int. Cl.
*B65B 1/04* (2006.01)
*B65B 3/04* (2006.01)

(52) U.S. Cl.
USPC ..... 141/9; 141/94

(58) Field of Classification Search
USPC ..... 428/34.1; 141/9, 94
See application file for complete search history.

(56) References Cited

FOREIGN PATENT DOCUMENTS

| | | | | |
|---|---|---|---|---|
| DE | 92 00 647 | U1 | 3/1992 | |
| DE | 20004954 | | 2/2002 | |
| DE | 100 61 418 | A1 | 8/2002 | |
| EP | 0 354 130 | A | 2/1990 | |
| EP | 0775668 | A1 * | 5/1997 | ..... B67C 3/20 |
| EP | 0 775 668 | B1 | 7/1999 | |
| EP | 1 207 108 | A | 5/2002 | |
| EP | 1 362 825 | A | 11/2003 | |
| GB | 854740 | | 11/1960 | |
| WO | 00/20327 | A | 4/2000 | |
| WO | 2006/091159 | A | 8/2006 | |
| WO | 2007/039074 | A | 4/2007 | |
| WO | 2008/037338 | A | 4/2008 | |

OTHER PUBLICATIONS

International Preliminary Report on Patentability received in International Application No. PCT/EP2009/002666 dated Nov. 18, 2010.

* cited by examiner

*Primary Examiner* — Michael C Miggins
(74) *Attorney, Agent, or Firm* — Occhiuti Rohlicek & Tsao LLP

(57) ABSTRACT

A method for filling bottles or similar containers (2) with a liquid filling material comprising at least two components, using a filling system (1) comprising at least one filling element (3) having a fluid channel (6) for the controlled dispensing of the filling material by way of at least one dispensing opening (11), said channel forming said dispensing opening, a liquid valve (13) being disposed in said channel and said channel being connected to a first component supply container or vessel (8) by way of a liquid connection (7).

5 Claims, 8 Drawing Sheets

10

10

METHOD AND FILLING SYSTEM FOR FILLING BOTTLES OR SIMILAR CONTAINERS WITH A LIQUID FILLING MATERIAL AND FILLING MATERIAL DISPENSED INTO CONTAINERS

CROSS-REFERENCE TO RELATED APPLICATIONS

This application is the National Stage of International Application No. PCT/EP2009/002666, filed on Apr. 9, 2009, which claims the benefit of the Apr. 22, 2008 filing date of German Application Serial No. 10 2008 020 271.1. The contents of both of the foregoing applications are hereby incorporated by reference in their entirety.

Beverages filled into bottles, cans or similar containers are for the most part mixed beverages where a main component, which makes up by far the largest part of the respectively filled product in terms of volume, has mixed therewith a further liquid addition component e.g. in the form of a taste-giving, highly concentrated flavouring. Said mixing is generated, in practice, inside a mixing system that is also referred to as a "mixer" and is located upstream of the filling machine in the process cycle, in which the product mixed from the two components is then filled into the containers.

Examples of these types of mixed beverages are, among other things, water+liquid flavouring or taste-giving addition, water+liquid flavouring or taste-forming addition+sugar, water+liquid flavouring or taste-giving addition+basic syrup etc. Mixed beverages produced in this manner are, for example, fruit juices or cola beverages, also with the addition of carbonation.

A disadvantage with said methods of operation, among other things, is that the mixer in which the components forming the mixed beverage (water and/or sugar and/or basic syrup and/or flavouring and/or carbonation) are mixed is a unit that is separated spatially from the filling machine, and that, consequently, there is a need for connecting lines between the mixer and the filling machine which, just as liquid connections inside the filling machine, contain a considerable liquid volume.

At each product change, for example when changing the addition component(s) but also when changing the basic component, it is necessary [to flush out] the entire liquid volume contained inside the overall system, in particular also from the pipelines between mixer and filling machine and from the individual supply lines of each filler valve. As a rule, a large part of said liquid volume has to be discarded at the same time.

In addition to the loss of high quality product that occurs in this case, it is also disadvantageous that in practice the product change or the component change is very time consuming just from the necessary emptying of the connecting lines.

In order to avoid these disadvantages, it has already been proposed (EP 0 775 668 B1) to mix an additional component to a basic component inside the respective filler element and during the filling procedure or during the filling phase by introducing said additional component in a monitored and controlled manner via a flow meter into the section of the liquid channel of the filler element that is directly connected to an annular tank or communicates via an opening with the annular tank, i.e. in the direction of flow of the liquid product upstream of the liquid valve located in the liquid channel. Among other things, the disadvantage of this is that an undesired mixing of the additional component with the first component or main component contained in the annular tank cannot be reliably avoided, such that during the filling operation, the main component contained in the annular tank is increasingly augmented by the additional component, thus making a filling of mixed beverages with a constant, reproducible quality not possible.

It is the object of the invention to provide a method which, with constant, reproducible quality of the filled product, enables a product change or component change and in this case especially a change in the at least one addition component, reducing the loss of high quality product and reducing expenditure of time.

In the case of a general embodiment of the invention, the addition of the at least one addition component to the first component or basic component is effected outside the respective filler element, preferably via at least one additional discharge opening for the at least one additional component, directly into the containers to be filled and/or into a flow of the at least one first component flowing to the container during the filling operation or during the filling phase.

Especially in the case of said embodiment of the method according to the invention, it is not necessary to mix the components before and/or during introduction into a container. It has been shown that the components are mixed sufficiently with the mixed liquid product, for example with the mixed beverage whenever the components are introduced separately and consecutively into the respective container. The mixing is effected then in many cases quasi automatically, for example through agitation and through the movements occurring during transport or when the container is handled. In addition, it is also possible, however, for the components not to be stirred up in the closed container until reaching the final consumer, for example by the container being shaken, whereas the components are deliberately present beforehand in the closed container, for example in such a manner that in a container made of transparent material (e.g. glass or crystal clear plastics material) the "colourless" basic component is situated above the somewhat heavier coloured and/or taste-forming further component or vice versa, which can also be utilized as an additional marketing effect.

In the case of another general embodiment of the invention, the addition of the at least one additional component to the first component or basic component is also effected outside the respective filler element or outside the liquid channel, realized in the filler element and containing the liquid valve, in the fluid or liquid connection between the respective filler element and a storage container or tank, via which the at least one first component or basic component is supplied to the respective filler element.

Advantages of the method according to the invention or of the device according to the invention consist, among other things, in that a constant, reproducible quality of the filled product is achieved, and in that the product volume to be discarded during a product or component change is small as no mixing product produced from the components or only a very small volume of such a mixing product is situated inside the connections of the filling system or of the respective filling machine. The amount of product to be discarded during a product change and also the time expended for a product change are consequently clearly reduced with reproducible filling results.

Further developments of the invention are the objects of the sub claims.

The invention is described below by way the Figures of exemplary embodiments, in which, in detail:

Figure 1:
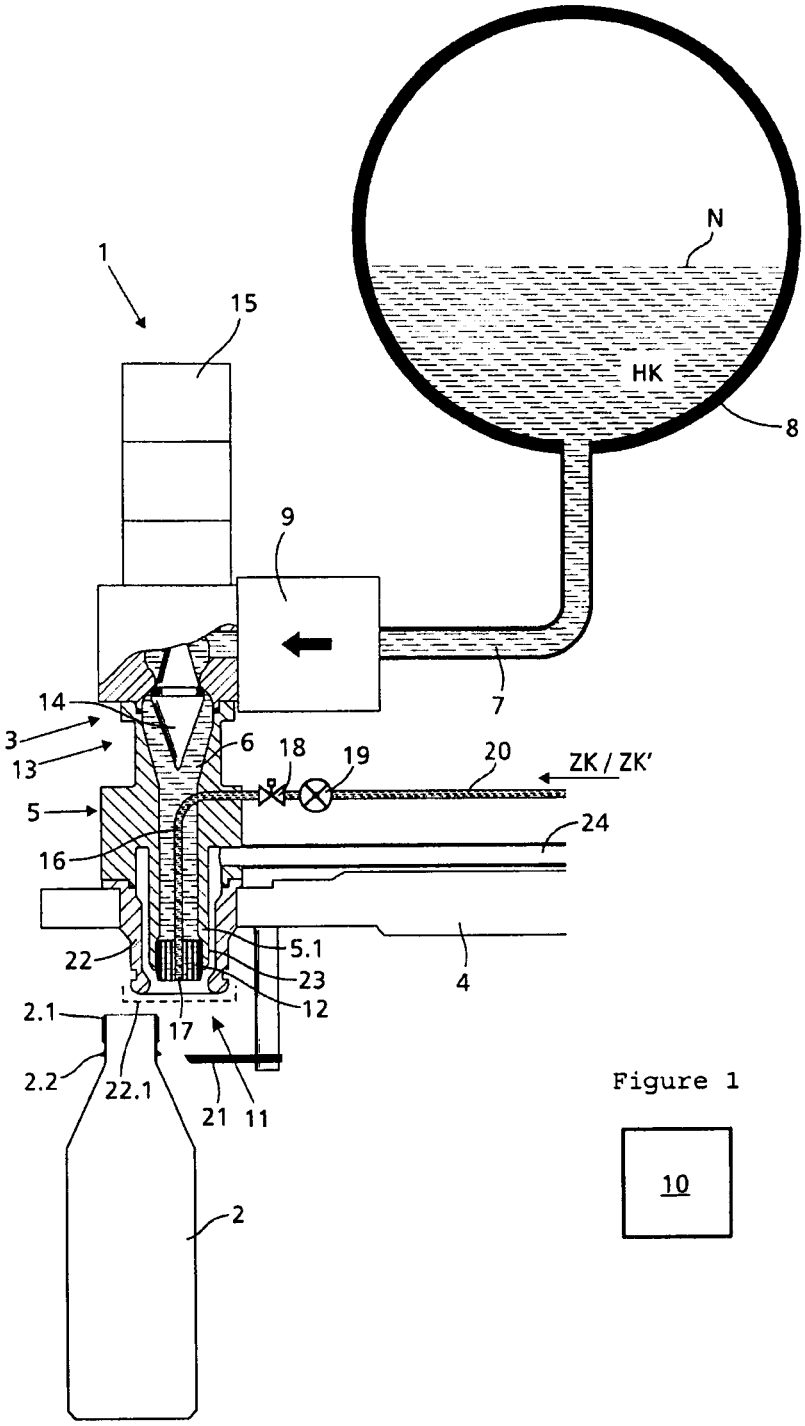
FIG. 1 shows a simplified representation of a filling system according to the invention, together with a container that is realized as a bottle.
Figure 2:
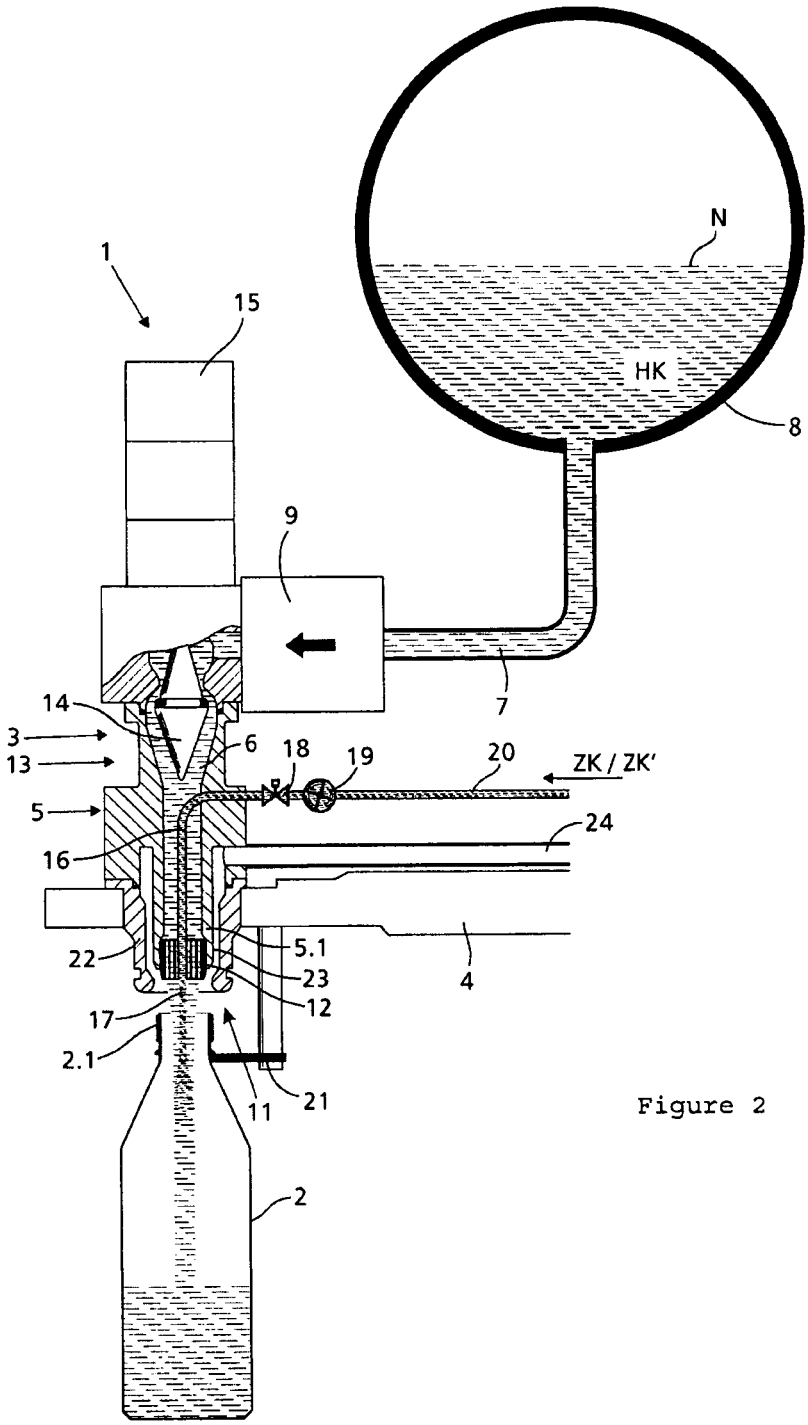
FIGS. 2 and 3 show the filling system in FIG. 1 in different operating states.
Figure 3:
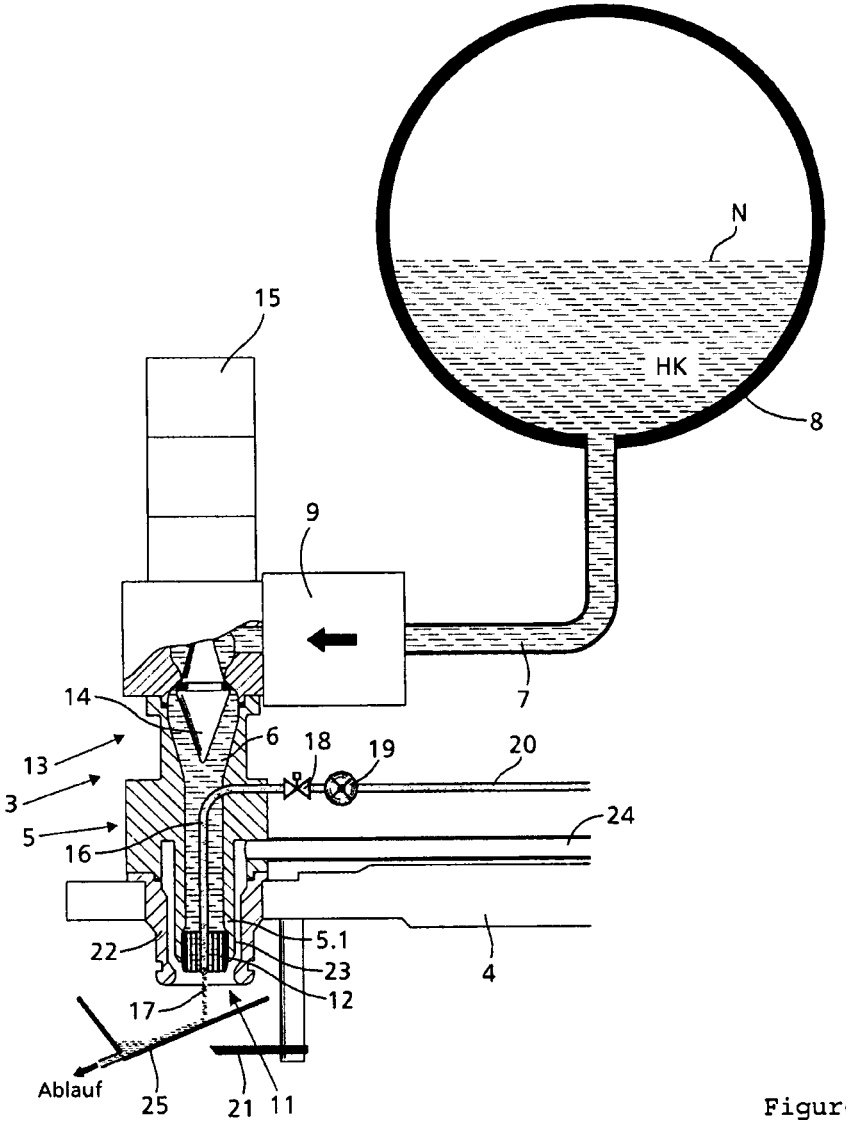

In FIGS. 1-3 the reference 1 is given in general to a filling system for filling bottles 2 with a liquid product or fill product which consists of at least two components, of which one is a basic or main component and one is an addition component or additional component ZK/ZK', for example a taste-forming and/or colour/giving addition.

The filling system 1, which in the embodiment represented is a component part of a filling machine of the rotary type, comprises in a known manner per se a filler element 3, which is provided with a plurality of similar-type filler elements at the periphery of a rotor 4 of the filling machine 1, said rotor being driveable in a rotating manner about a vertical machine axis.

A liquid channel 6 is realized in a housing 5 of the filler element 3, said liquid channel, at an upper end via a liquid connection formed at least partially by a line 7, serving, with the tank 8, which is common to all the filler elements 2 of the filling system 1 and is provided on the rotor 4, for the accommodating of the main component or first component. In the case of an operational filling system 1, the tank 8, which is realized, for example, as an annular tank, is filled in a level-controlled manner up to the level N with the component HK.

In the liquid connection between the tank 8 and each filler element 3 or its liquid channel 6, there is provided a flow meter 9, which, for example, is a magnetic/inductive flow meter supplying an electric signal, which corresponds to the volume flow or to the amount of component HK flowing to the respective filler element 3, to a control unit 10 that is formed, for example, by a computer, said control unit being provided in common for all the filler elements 3 of the filling system 1 and, for example, being the computer controlling the filling machine.

In the region of the underside of the filler element 3, the liquid channel 6 forms a discharge opening 11 for discharging the liquid product to each bottle 2 to be filled. A gas block 12 is provided in the discharge opening 11, said gas block in the embodiment represented being formed by an insert that is provided with a plurality of passages or channels in the manner of a sieve.

A liquid valve 13 for the controlled discharge of the component HK is located in the liquid channel 6 between the upper connection to the liquid connection 7 and the bottom discharge opening 11. In a known manner the liquid valve 13 comprises a valve body 14, which is moveable up and down in the vertical direction between a closed position and an open position, i.e. in the axis of the filler element FA, and in the closed position abuts against a valve seat in the liquid channel 6 by way of a seal. The controlled opening and closing of the liquid valve 13 is effected via an actuating device 15 controlled by the control unit 10, among other things also as a function of the measuring signal supplied by the flow meter 9.

The reference 6 in FIG. 1 identifies a fluid connection formed by a fluid channel, said fluid connection being used for introducing the additional component ZK into the respective bottle 2 and, for this purpose, forms an additional discharge opening 17 on the underside of the filler element 3. In the case of the embodiment in FIGS. 1-3, the discharge opening 17 is provided on the identical axis as the filler element axis FA on the underside of the gas block 12. The fluid connection 16, which, for example, comprises a pipe section introduced in a sealed manner from the side into the liquid channel 6 below the liquid valve 13 or the filler element 3, is connected outside the liquid channel 6 or the filler element 3 to the outlet of a metering pump 19 via an actuatable (e.g. electrically or pneumatically controllable) stop valve 18, said metering pump also being controlled by the control unit 10 and the input of said metering pump being connected to a line 20, which leads to a storage container or tank (not represented) for the component ZK. The metering pump 19 is realized such that it conveys a precisely defined volume in the case of continuous operation for each pump revolution or in the case of a pulsed or pulse-shaped method of operation in each cycle.

Each filler element 3 has associated therewith a container support 21, on which, in the embodiment represented, the respective bottle 2 is held suspended at a flange 2.2 that is formed below the bottle mouth 2.1, in such a manner that the bottle mouth 2.1 is at a spacing from the underside of the filler element 3 and consequently from the discharge openings 11 and 17 at that location and also from the bottom, open end of a ring-shaped insert 22, such that the two components HK and ZK are supplied to the respective bottle 2 to be filled as an open jet, as is represented in FIG. 2.

The insert 22 surrounds the lower tubular housing section 5.1 of the housing 5 forming the discharge opening 11 at a spacing, such that an annular channel 23 is formed between the inside surface of the ring-shaped insert 22 and the outside surface of the housing section 5.1. In addition, the insert 22 extends downward somewhat beyond the underside of the gas block 12 and also beyond the discharge openings 11 and 17 such that once the bottom open end of the insert 22 has been closed by way of a flushing cap 22.1, indicated by the broken line, and with liquid valve 13 open, a CIP cleaning operation is possible using a cleaning medium, which, for example, traverses the liquid channel 6 from top to bottom and is then conducted away via the annular gap 23 and a line 24 connected to said annular gap. The discharge opening 17 and the associated liquid paths (fluid connection 16, stop valve 18, metering pump 19, line 20 etc.) can be included in said CIP cleaning operation.

A possible mode of operation of the filling system 1 for the introduction of the components HK and ZK can be seen in FIG. 2. Once the bottle 2 to be filled is positioned on the container support 21, the filling phase is introduced by opening the liquid valve 13, in which filling phase the component HK is introduced into the bottle 2 through the bottle opening 2.1 in the open jet. At the same time, with the stop valve 18 open, by actuating the metering pump 19, a predetermined amount of the component ZK is added in a precisely metered manner into the flow of the component HK flowing to the bottle 2. As soon as the necessary amount of the component ZK has been delivered via the discharge opening 17 and has consequently been introduced into the bottle 2, the introducing of the component ZK into the respective bottle 2 is terminated by blocking the stop valve 18 or by switching off the metering pump 19, such that then up until the bottle 2 is completely filled, only the component HK is still supplied. The filling phase is terminated in a controlled manner by the signal of the flow meter 9 by closing the liquid valve 13 once the desired fill volume has been achieved.

The mode of operation where the supplying of the component HK ends before the liquid valve 13 is closed, has the advantage that in the region of the discharge opening 17 or in the region of the underside of the gas block 12, any potentially present residue of the component ZK is entrained by the component HK and is introduced into the bottle 2 provided at the filler element 3, such that clear conditions prevail at the start of each new filling phase. It is obvious that where there is a plurality of filler element 3 on the rotor 4, there is an independent metering pump 19 and an independent stop valve 18 provided for each filler element 3 and they are individually controllable for each filler element 3.

The filling system 1 also enables a change of the component HK and/or ZK. The changing of the component HK is effected in the conventional manner by emptying the filling system 1 with regard to the component HK and, where applicable, by subsequently flushing and/or cleaning the filling system 1 and also all the fluid connections and paths inside the filler elements 3 preferably by using a CIP cleaning method.

The achievement of using the gas block 20 is that once the liquid valve 13 has been closed, i.e. at the end of each filling phase, the part of the liquid channel 6 located below the liquid valve 13 continues to be filled completely with the component HK without any dripping of the filler element 3. In addition, the cross section of the fluid connection 16 or of the fluid channel forming said fluid connection, in particular at the discharge opening 17 is selected such that after terminating the discharging of the component ZK, i.e. once the valve 18 has been blocked and the metering pump 19 switched off, the part of the fluid connection 16 extending between the stop valve 18 and the discharge opening 17 continues to be filled with the component ZK without any dripping from the discharge opening 17. Consequently, at the start of each new filling phase the two components HK and ZK are immediately available, i.e. with no delay.

For changing the component ZK for another component ZK', for example for a component that differs in taste and/or colour, corresponding to FIG. 3, initially with liquid valve 13 closed, all the flow connections that contain the component ZK used up to then are flushed in a flushing process using a flushing medium, for example water or sterile water, in particular the fluid connection 16, the opened stop valve 18, the metering pump 19 and the line 20 leading to the metering pump 19, in so far as they contain the component ZK. The metering pump is preferably driven during said flushing operation. Said flushing is obviously effected without any bottles 2 at the filler elements 3. The liquid accumulating during the flushing process (flushing medium+residue of the component ZK) is collected by a collecting tray 25 that is located underneath the filler element 3 with suitable drainage. In the case of a filling machine of the rotary type, said collecting tray 25 is provided, for example, fixedly on a machine element below the path of movement of the filler elements 3, in that angular region of the rotational movement of the rotor 4 that is formed between a container outlet, at which the filled bottles 2 are removed during the filling operation, and a container inlet, to which the empty bottles 2 are supplied during the filling operation, and also at which (angular region) no bottle 2 is situated at the filler elements 3 during a normal filling operation.

Once the fluid connection 16, the stop valve 18, the metering pump 19 and the line 20 of each filler element 3 connected to the input of the metering pump has been flushed, with the metering pump 19 still being driven and with stop valve 18 open, the component ZK' is supplied or drawn up just until said component has reached the discharge opening 17 or exits there. Since the volume previously flushed and collected from the flushing liquid after the flushing process is known, this drawing up of the component ZK' can be effected in principle through corresponding control of the metering pump 19 or of the volume flow conveyed by said pump.

If the collecting tray 25 is provided as described in a fixed manner on the rotary type filling machine, the adapting or changing of the component ZK to the component ZK' is effected in a sectional manner at the filler elements 3 located in each case above the collecting tray 25 by rotating the rotor 4, e.g. by rotating the rotor 4 continuously but very slowly or with the rotor 4 rotating in a clocked manner.

Figure 4:
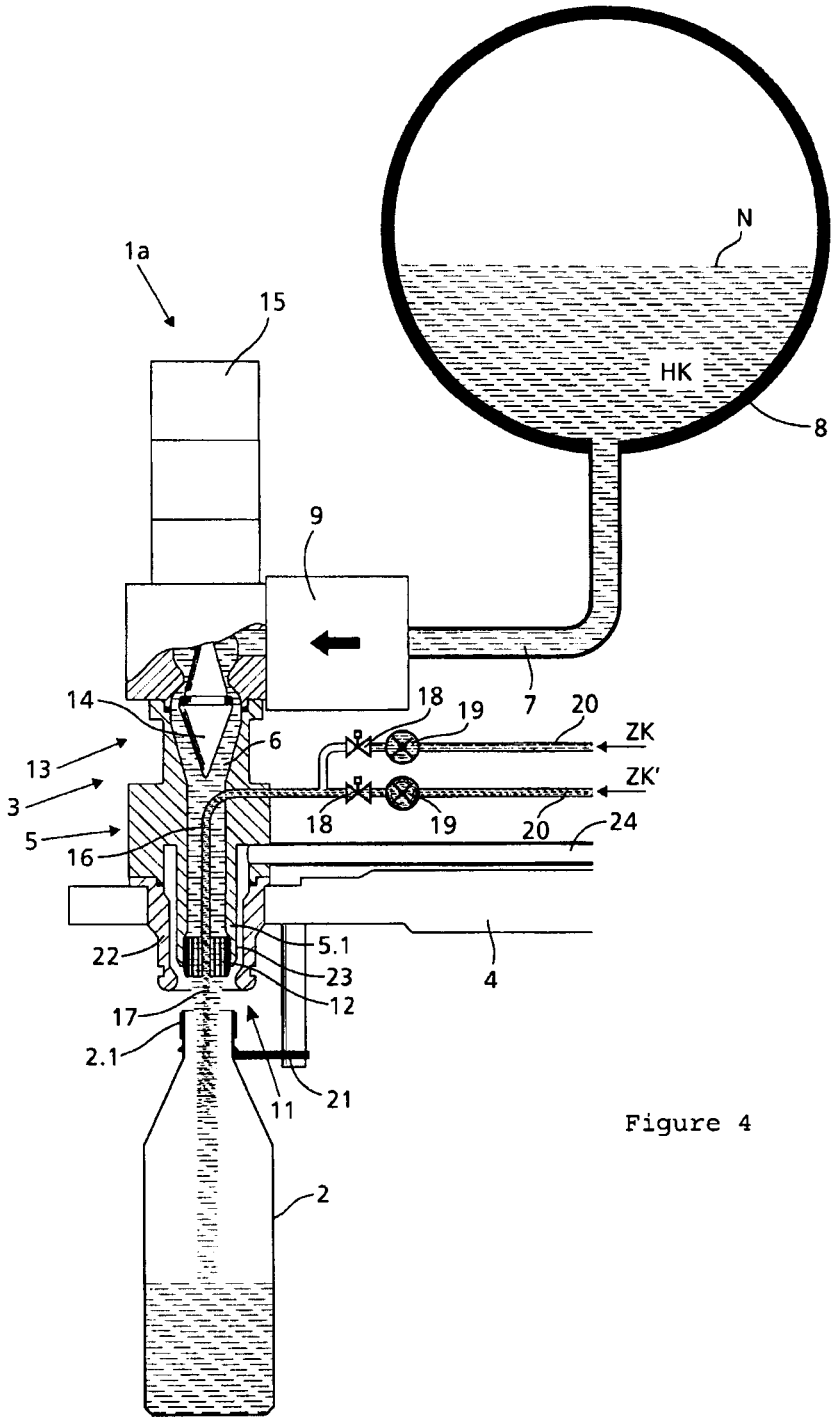
FIGS. 4 and 5 show representations as in FIG. 1 of modified embodiments of the filling system in FIG. 1.

It has been assumed above that each filler element 3 has a common metering pump 19 with stop valve 18 for the two components ZK and ZK' and the two components are also conducted in a corresponding manner via the line 20 to the metering pump 19. FIG. 4 shows a filling system 1*a*, which differs from the filling system 1 in that at each filler element 3 an independent metering pump 19 is provided in each case for the components ZK and ZK', the input of said metering pump being connected via a line 20 to a storage container or tank for the relevant component. Each metering pump 19 is connected via an independent, electrically controllable stop valve 18 to the fluid connection 16 which is then common to the two components.

In addition, the filling system la also enables the volume-controlled introduction of the components ZK and ZK' into the respective bottles 2 within one and the same filling phase. The components ZK and ZK' are introduced into the respective bottle 2 for this purpose in a time-delayed manner, for example through corresponding actuation of the associated metering pump 19 and of the valve 18, in such a manner that the introducing of the components ZK and ZK' is started with one of said components, for example with the component ZK and is also terminated with the same component such that after the filling of each bottle 2, i.e. at the end of each fill phase, the same conditions prevail with regard to the component ZK or ZK' pending at the discharge opening 17.

Figure 5:
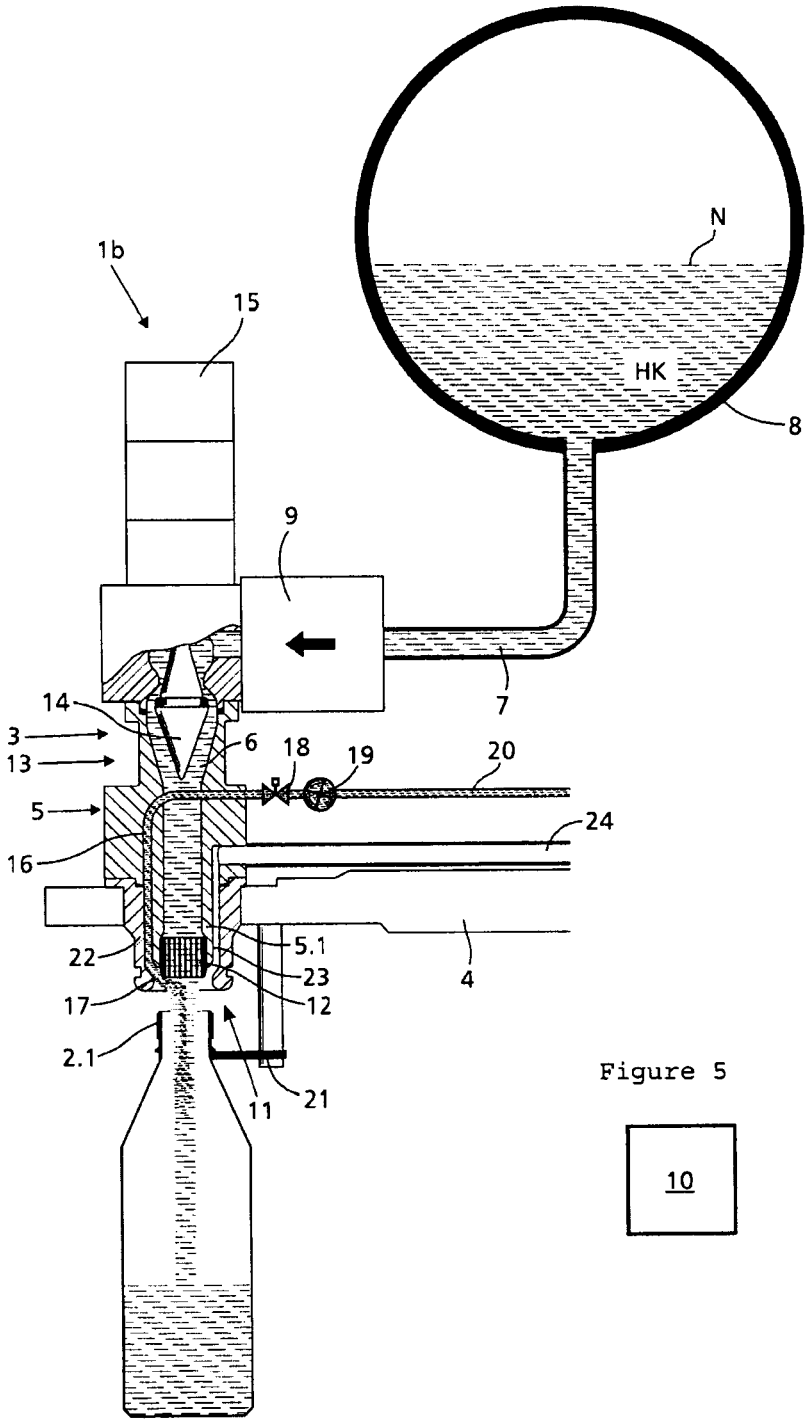

FIG. 5 shows a filling system 1*b*, which differs from the filling system 1 simply in that the discharge opening 17 for the component ZK or ZK' is provided radially offset in relation to the filler element axis FA or in relation to the axis of the discharge opening 11, in such a manner that the discharge opening 17 is situated outside the discharge opening 11 and outside the gas block 12, however in the manner that the jet of the component ZK or ZK' emerging out of the discharge opening 17 is introduced reliably through the bottle opening 2.1 into the bottle 2 provided at the filler element 3.

In the case of the filling systems 1-1*b*, the tanks for the components ZK and ZK' are provided for all the filler elements 3 or for a group of several filler elements of the filling machine in common. The metering pumps 19 and the associated stop valves 18, contrary to this, are provided separately for the individual filler elements 3 and are individually controllable.

Figure 6:
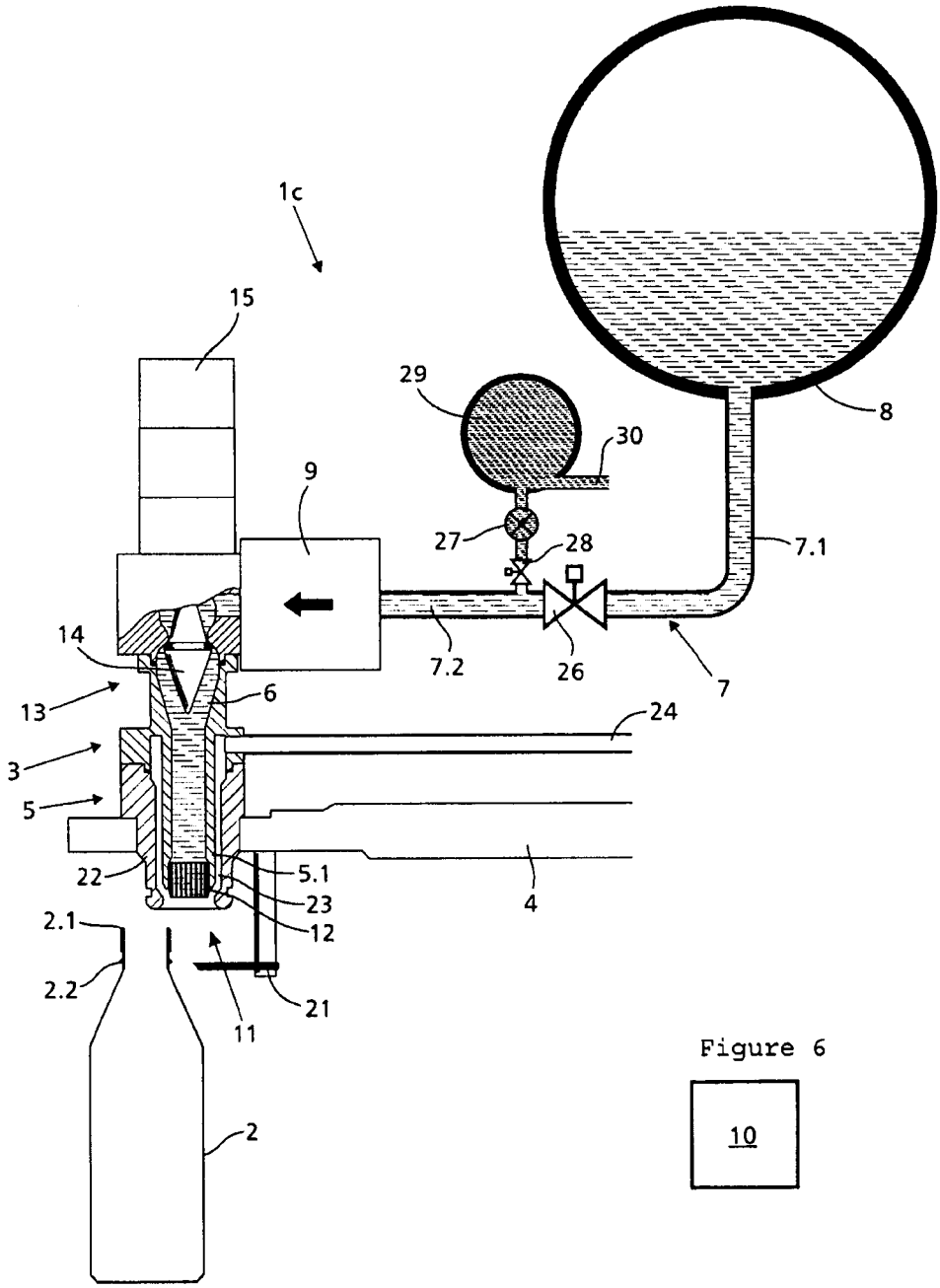
FIG. 6 shows a representation similar to FIG. 1 of a further embodiment of the filling system according to the invention.
Figure 7:
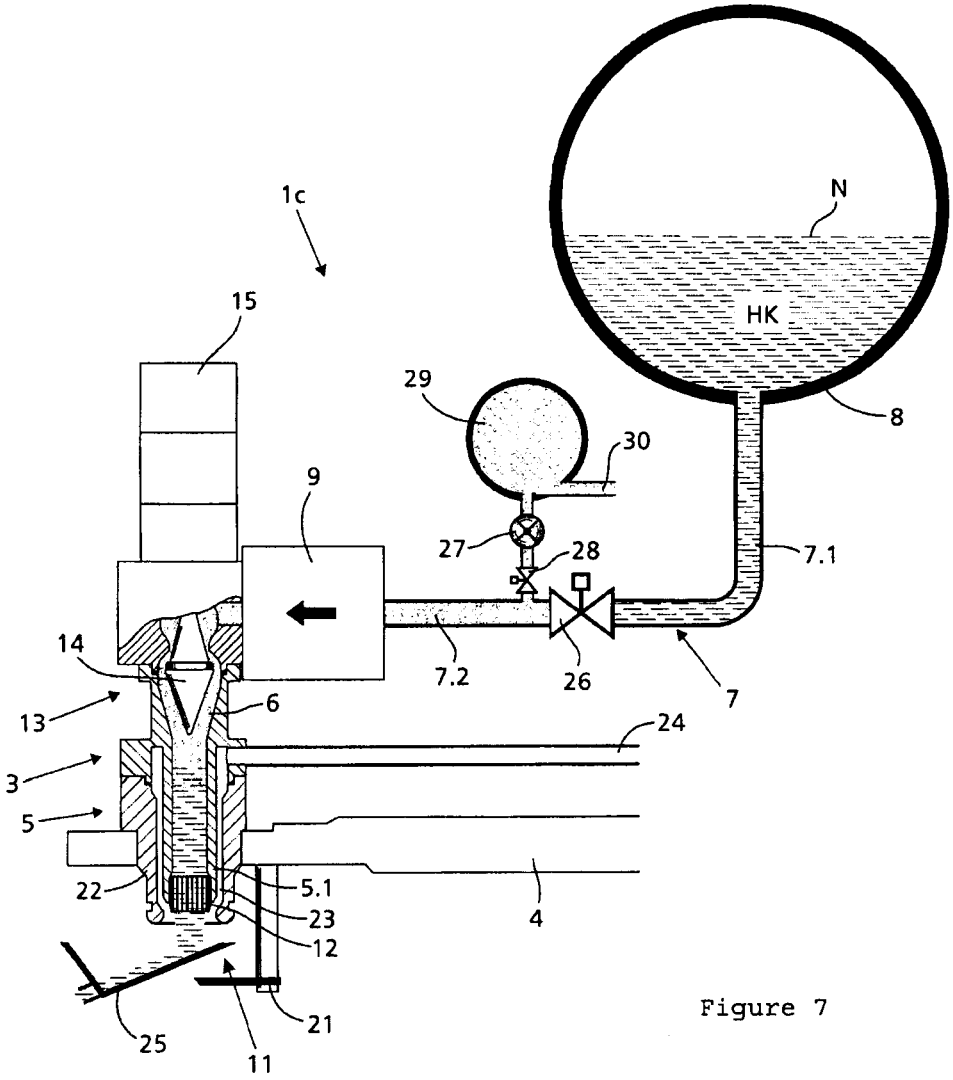
FIG. 7 shows the filling system in FIG. 6 in the operating state of "flushing"

FIGS. 6 and 7 show, as a further embodiment, a filling system 1*c*, which differs from the filling system 1-1*b* in that the introducing of the additional component ZK or ZK' is indeed once again outside the filler element 3, but is already in the fluid connection between the tank 8 and the relevant filler unit 3, i.e. in the line 7. For this purpose, an independent, actuatable (e.g. electrically or pneumatically actuatable) stop valve 26 is provided in the line 7 for each filler element 3, the input of said stop valve communicating via a line section 7.1 with the tank 8 and the output of said stop valve communicating via a line section 7.2 with the flow meter 9. The metering pump 27, once again provided individually for each filler element 3, is connected via an actuatable (e.g. electrically or pneumatically actuatable) stop valve 28 to the line section 7.2. The input of the metering pump 27 is connected to a tank 29 for the component ZK or ZK', said tank being supplied with said component via a line 30. The metering pump 27 is once again realized such that it conveys a precisely defined volume, in the case of continuous operation at every pump revolution or in the case of pulsed or pulse-shaped operation in each cycle.

Once the bottle 2 has been positioned under the filler element 3 or below the discharge opening 11 provided at that location with the gas block 12 and once the filling phase has been introduced by opening the liquid valve 13, during a part phase of said filling phase, after opening the stop valve 28, the volume-controlled introduction of the component ZK or ZK' into the line section 7.2 is effected via the metering pump 27, preferably with the stop valve 26 blocked beforehand in order to avoid ingress of the component ZK or ZK' into the tank 8 in a reliable manner. The introducing of the component ZK or ZK' is terminated by closing the stop valve 28 and by switching off the metering pump 27 so that the filling of the respective bottle 2 with the component HK can be effected or continued by opening the stop valve 26.

With consideration to the liquid volume that is located in the fluid connection between the output of the stop valve 28 and the discharge opening 11, the part filling phase, in which the component ZK or ZK' is introduced into the line section 7.2, is selected such that and is provided within the overall filling phase such that, with the component HK flowing to the respective bottle 2, after the closing of the stop valve 28 and opening of the stop valve 26, the entire portion of the component ZK or ZK' introduced previously is entrained into the bottle 2 before the filling phase in terminated. As soon as the overall volume (volumes of the component HK and the component ZK or ZK') measured by the flow meter 9 corresponds to the desired fill quantity, the filling phase is terminated by closing the liquid valve 13.

The filling system 1*c* obviously also allows a change between the components ZK and ZK'. For this change, according to FIG. 7, with stop valve 26 closed, stop valve 28 open and liquid valve 13 open, the tank 29, the metering pump 27, the stop valve 28, the line section 7.2, the flow meter 9, the liquid channel 6 and the discharge opening 11 with the gas block 12 are flushed with a suitable liquid flushing medium, for example water such that all residue of the component ZK or ZK' used up to then is removed. The liquid accumulating during this flushing operation is once again collected in the collecting tray 25. After the flushing operation, the new component ZK' or ZK to be used is first of all drawn up in such a manner that said component is supplied via the line 30 such that, with the stop valve 26 continuing to be closed and stop valve 28 open and liquid valve 13 open, it then fills out not only the tank 29 but also the line section 7.2 and the liquid channel 6 and finally emerges at the discharge opening 12. Following this, with stop valve 28 closed and stop valve 26 open, the line section 7.2 and the liquid channel 6 are flushed with the component HK such that at the end of the component change, with liquid valve 13 closed once again, a state is reached in which the entire line 7 and also the liquid channel 6 are filled with the component HK.

Figure 8:
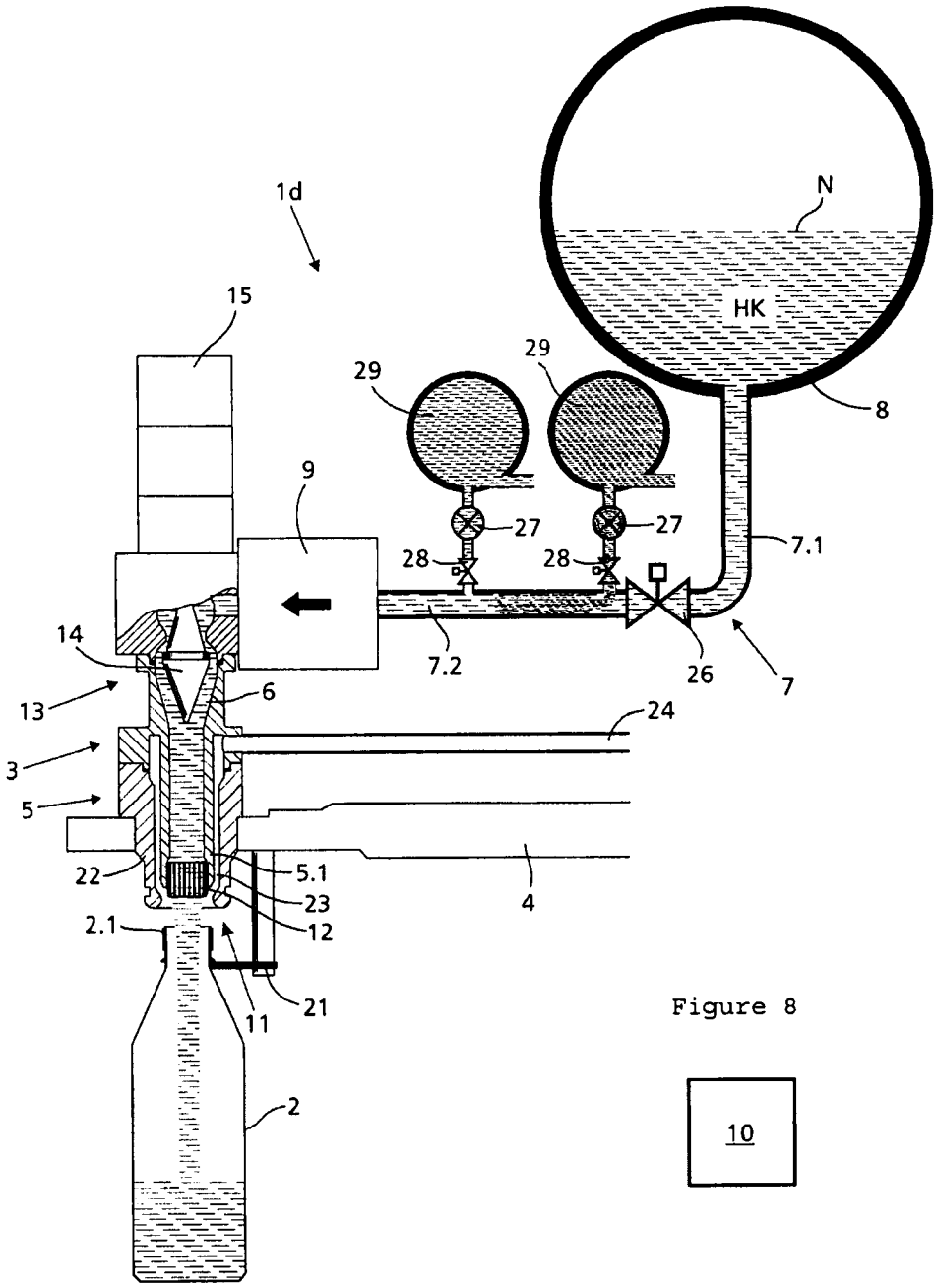
FIG. 8 shows a modification of the filling system in FIG. 6.

Finally FIG. 8 shows a filling system 1*d*, which differs from the filling system 1*c* only in that a separate tank 29 is provided for each component ZK and ZK', said tank communicating with the line section 7.2 via the metering pump 27 and the stop valve 28, having the advantage, among other things, that in the case of a component change, a flushing operation of the respective tank 29, the associated metering pump 27 and of the associated stop valve 28 is not necessary and it is also possible to introduce the components ZK and ZK' into the bottle 2 during the filling phase.

In the case of the filling systems 1*c* and 1*d*, the tanks 29 for the components ZK and ZK' are provided, once again, common to all the filler elements 3 or to a group of several filler elements of the filling machine. The metering pumps 27 and the associated stop valves 28, contrary to this, are provided separately for the individual filler elements 3 and are individually controllable.

Common to all the embodiments described above is, among other things, that the components ZK or ZK' are each added via the metering pump 19 or 27 in a volume controlled manner, and that each metering pump 19 or 27 has associated therewith a stop valve 18 or 28, which, among other things, enables a delay-free start and a delay-free termination of the addition of the respective components ZK or ZK'.

In the case of the filling systems and in this case especially also in the case of the filling systems 1-1*b*, it is also possible to control or to regulate the portion of the component ZK or ZK' introduced into the respective bottle 2 by using flow meters, which are then provided in place of the metering pump 19 or 27 or in addition to said metering pump in the liquid channel upstream or downstream of the stop valve 18 or 28, which is then controlled by the control unit 10 as a function of the signal from said flow meter.

The invention has been described above by way of exemplary embodiments. It is obvious that numerous changes and conversions are possible without in any way departing from the inventive concept underlying the invention. Thus, the number of components that are introduced into the bottles or containers in a selective manner or also in each case together in addition to the main component HK can be arbitrary.

The present invention can also be utilized to fill several different products in parallel on one filling machine during the current operation at one point in time. Thus, it is possible, for example, to fill all the bottles 2 to be filled with the main component HK, a first addition component ZK being supplied through the filler elements 3 of a first number of bottles 2 and a second addition component ZK' being supplied through the filler elements 3 of a second number of bottles 2. In this case, the ratio between the first number of bottles 2 and the second number of bottles 2 can be arbitrary. The spatial arrangement of the first bottles 2 to the spatial arrangement of the second bottles can also be arbitrary. For example, these can alternate or can also be provided in blocks on the rotor 4. This method of operation makes it possible to generate an arbitrary product mix without the need for any adaptation.

LIST OF REFERENCES

1, 1*a*-1*d* Filling system
2 Bottle
2.1 Bottle mouth
2.2 Flange
3 Filler element
4 Rotor
5 Filler element housing
6 Liquid channel
7 Line or fluid connection
7.1, 7.2 Line section
8 Tank
9 Flow meter
10 Control electronics
11 Discharge opening
12 Gas block
13 Liquid valve
14 Valve body
15 Actuating device
16 Fluid connection or liquid channel
17 Discharge opening
18 Stop valve

19 Metering pump
20 Line
21 Container support
22 Insert
22.1 Closure
23 Annular gap
24 Line
25 Collecting tray
26 Stop valve
27 Metering pump
28 Stop valve
29 Tank
30 Channel
N Level of the liquid surface of the component HK in the tank
HK, ZK, ZK' Component
FA Filler element axis

The invention claimed is:

1. An apparatus comprising a filling system for open stream filling of a container with a liquid filling material comprising at least a first component and a second component, said apparatus comprising a fill element for controlled delivery of said first component through a first delivery opening formed at least in part by a liquid channel, a liquid valve disposed in said liquid channel, a liquid connection for connecting said liquid channel to a supply vessel that contains said first component, a second delivery opening provided at said first delivery opening through which said second component is delivered in a dosed manner in an open stream flowing into said container or to an open stream of said first component exiting from said fill element and flowing into said container, at least one of a flow meter and a dosage pump, said at least one of a flow meter and a dosage pump being disposed to control flow of said second component, and a gas barrier disposed at said first delivery opening, wherein said second delivery opening passes through said gas barrier.

2. The apparatus of claim 1, further comprising a controllable barrier valve, wherein said second delivery opening is connected to said at least one of a dosage pump and a flow meter, and wherein said at least one of a dosage pump and a flow meter is disposed in series with said controllable barrier valve.

3. The apparatus of claim 1, wherein said at least one of a dosage pump and a flow meter comprises at least one of at least two dosage pumps and at least two flow meters, said at least one of at least two dosage pumps and at least two flow meters being connected, through a barrier valve, to at least one of said liquid channel and said second delivery opening.

4. The apparatus of claim 1, further comprising a sealing element, wherein at least one of said first and second delivery opening opens into a space, and wherein said sealing element is configured to seal said space during a CIP cleaning.

5. A method for open stream filling of a container with a liquid filling material comprising at least a first component and a second component, said method comprising providing the apparatus recited in claim 1, and, using said apparatus, introducing said second component of said liquid product into one of said container and said liquid channel connecting said filler element to said vessel, wherein said second component of said liquid product is metered outside said filler element.

* * * * *